US007868870B2

(12) United States Patent
Ito

(10) Patent No.: US 7,868,870 B2
(45) Date of Patent: Jan. 11, 2011

(54) OPERATION APPARATUS

(75) Inventor: Masahiro Ito, Ichinomiya (JP)

(73) Assignee: DENSO Corporation, Kariya (JP)

( * ) Notice: Subject to any disclaimer, the term of this patent is extended or adjusted under 35 U.S.C. 154(b) by 965 days.

(21) Appl. No.: 11/656,905

(22) Filed: Jan. 23, 2007

(65) Prior Publication Data

US 2007/0170046 A1 Jul. 26, 2007

(30) Foreign Application Priority Data

Jan. 26, 2006 (JP) ..... 2006-017102

(51) Int. Cl.
*G09G 5/00* (2006.01)

(52) U.S. Cl. ..... 345/156; 345/650; 345/634; 345/169

(58) Field of Classification Search ..... 345/156–158, 345/161, 163, 166, 169, 173–179, 184, 419, 345/424, 634, 650; 348/42, 169, 566, 578; 455/550.1, 566; 382/209, 188, 118, 284; 200/11 R See application file for complete search history.

(56) References Cited

U.S. PATENT DOCUMENTS 4,951,510 A * 8/1990 Holm-Kennedy et al. ..... 73/862.041
5,160,918 A * 11/1992 Saposnik et al. ..... 345/161
5,289,442 A * 2/1994 Van Rosmalen ..... 369/44.22
5,337,298 A * 8/1994 van Rosmalen ..... 369/44.22
5,847,694 A * 12/1998 Redford et al. ..... 345/158
6,121,955 A * 9/2000 Liu ..... 345/161
6,362,810 B1 * 3/2002 Matsuda ..... 345/161
6,480,183 B1 * 11/2002 Van Ruymbeke et al. ... 345/161
6,606,085 B1 8/2003 Endo et al.
7,352,358 B2 * 4/2008 Zalewski et al. ..... 345/156
7,737,944 B2 * 6/2010 Harrison et al. ..... 345/156
2002/0024503 A1 * 2/2002 Armstrong ..... 345/167
2005/0077156 A1 * 4/2005 Ushimaru et al. ..... 200/6 A
2005/0162389 A1 * 7/2005 Obermeyer et al. ..... 345/161

(Continued)

FOREIGN PATENT DOCUMENTS

JP 10-199374 7/1998

(Continued)

OTHER PUBLICATIONS

Notice of Reasons for Rejection mailed Mar. 30, 2010 in corresponding Japanese application No. 2006-17102.

*Primary Examiner*—Prabodh M Dharia
(74) *Attorney, Agent, or Firm*—Harness, Dickey & Pierce, PLC

(57) ABSTRACT

An operation unit is used for a user to perform a tilt operation. The operation unit includes a disc-shaped detection subject member with a detection subject plane, which intersects with a basic axis Q of the operation unit and is movable integrally with the operation unit. Three detecting units are fixed in three different disposed positions surrounding a neutral axis N to detect displacement parallel with the neutral axis, which is generated by movement of the detection subject plane. A computing unit determines three-dimensional detected positions M1, M2, M3 of the detection subject plane by using (i) the disposed positions (X, Y) of the three detecting units and (ii) displacement detection outputs Z detected by the three detecting units. A tilt direction, in which the operation unit is tilted, is determined using a displacement plane DP defined by the three-dimensional detected positions M1, M2, M3.

23 Claims, 11 Drawing Sheets

U.S. PATENT DOCUMENTS

2006/0050056 A1* 3/2006 Armstrong ..... 345/161

FOREIGN PATENT DOCUMENTS

JP 2001-159953 6/2001
JP 2002-055773 2/2002
JP 2002-202850 7/2002
JP 2003-220893 8/2003
JP 2003-308760 10/2003

* cited by examiner (ROTATION)

(PRESS)

OPERATION APPARATUS

CROSS REFERENCE TO RELATED APPLICATION

This application is based on and incorporates herein by reference Japanese Patent Application No. 2006-17102 filed on Jan. 26, 2006.

FIELD OF THE INVENTION

The present invention relates to an operation apparatus used for operating an electronic apparatus.

BACKGROUND OF THE INVENTION

Patent documents 1 and 2 propose operation apparatuses using tilt operations for input to electronic apparatuses. For instance, a tilt operation is performed in a predetermined direction with a predetermined tilt center functioning as a supporting point. Of this tilt operation, displacement in the predetermined direction is detected, as an input, by a detector such as a sensor or switch.

In these operation apparatuses, one detector is assigned to one tilt direction; in specific, each of four detectors is provided to detect one of four tilt directions. This causes disadvantage that a large number of detectors are required although the number of tilt directions is relatively limited. This does not allow additional increase in the number of tilt directions or continuous detection in all the directions. This does not propose detection for another operation other than the tilt operation.

Patent document 1: JP-2003-220893 A

Patent document 2: JP-2002-202850 A

SUMMARY OF THE INVENTION

It is an object of the present invention to provide an operation apparatus to allow the number of detecting units to be smaller than the number of detected tilt directions. Further, this operation apparatus can provide an improvement to increase the number of tilt directions, to uninterruptedly detect tilt directions, or to include detection for another operation other than the tilt operation.

According to an aspect of the present invention, an operation apparatus is provided as follows. An operation unit is included for a user to hold to perform an operation including a tilt operation, wherein a basic axis of the operation unit tilts in a certain radial direction among at least four radial directions with respect to a neutral axis. A detectable member is included to have a detectable plane, which intersects with the basic axis and makes a movement integrated with the operation of the operation unit. A displacement detector is included to have three detecting units fixed in disposed positions surrounding the neutral axis for detecting displacement, which is generated by the movement of the detectable plane and parallel with the neutral axis. A computing unit is included to compute operation output data indicating the certain radial direction, in which the operation unit tilts, by using (i) the disposed positions of the three detecting units and (ii) the displacement, which is generated by the movement of the detectable plane and detected by the displacement detector.

BRIEF DESCRIPTION OF THE DRAWINGS

The above and other objects, features, and advantages of the present invention will become more apparent from the following detailed description made with reference to the accompanying drawings. In the drawings.

DETAILED DESCRIPTION OF THE PREFERRED EMBODIMENTS

Figure 1A:
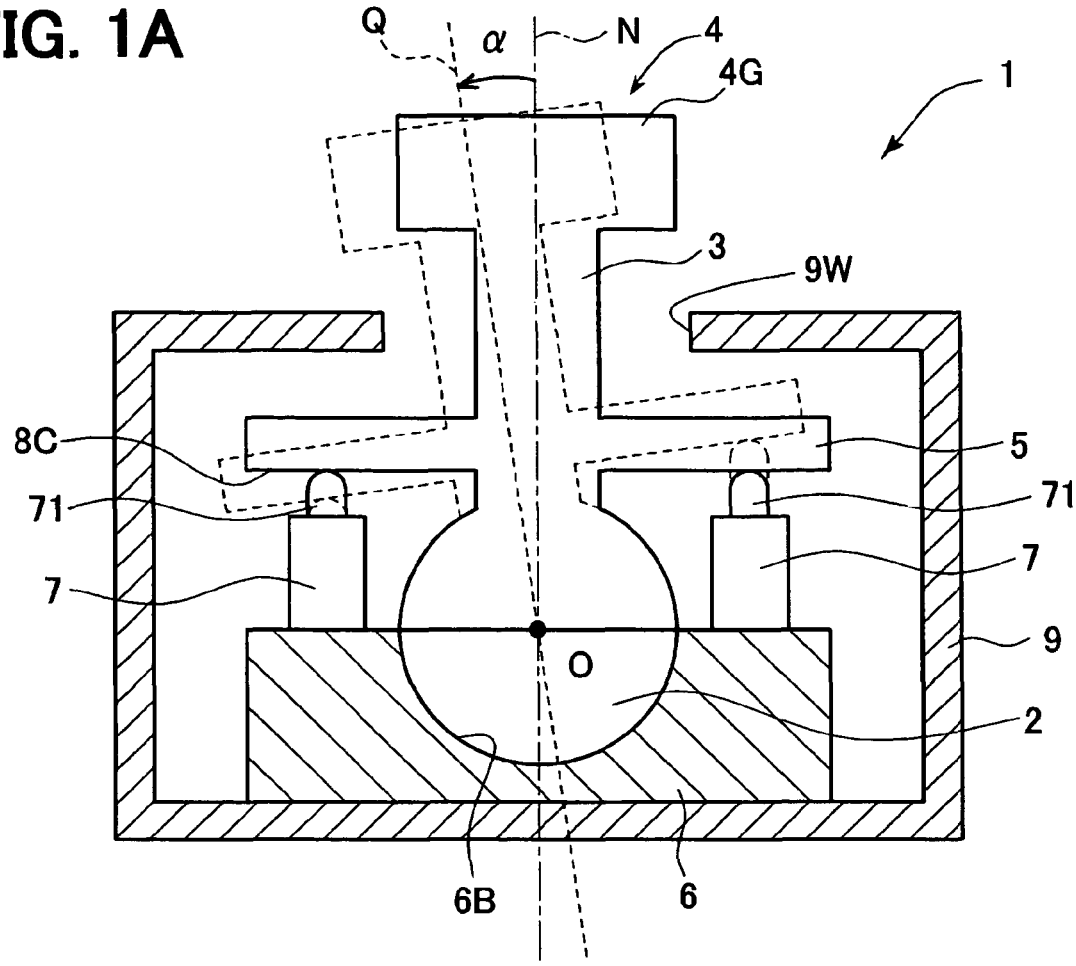
FIG. 1A is a cross-sectional front view illustrating a main structure of an operation apparatus according to an embodiment of the present invention.

An operation apparatus as an embodiment according to the present invention will be explained below. As shown in FIG. 1, an operation apparatus 1 includes (i) an operation unit 4 for a user to hold and tilt for performing a tilt operation and (ii) a reception unit 6 to receive and support the operation unit 4. Here, as a force is applied to tilt the operation unit 4, the reception unit 6 allows a basic axis Q of the operation unit 4 to tilt against a neutral axis N towards one of mutually different more than three radial directions with a tilt center O located on the basic axis Q functioning as a supporting point. In this embodiment, multiple radial directions can be uninterruptedly detected within 360 degrees around the neutral axis N.

The operation unit 4 includes a detection subject member (or detectable member) 5, which tilts integrally with the operation unit 4. The detection subject member 5 is shaped of a disc to outwardly protrude from the circumferential surface of the operation unit 4 to intersect with the basic axis Q. On one side of the disc, a detection subject plane (or detectable plane) 8C is uninterruptedly arranged circumferentially with respect to the basic axis Q.

Three detecting units 7 (all of the detecting units 7 is referred to as a displacement detector) are installed to surround the neutral axis N and the operation unit 4. Each of the detecting units 7 abuts to a corresponding position on the detection subject plane 8C to detect a displacement parallel with the neutral axis N in the corresponding position on the detection subject plane 8C when a tilt operation is applied to the operation unit 4.

Figure 8:
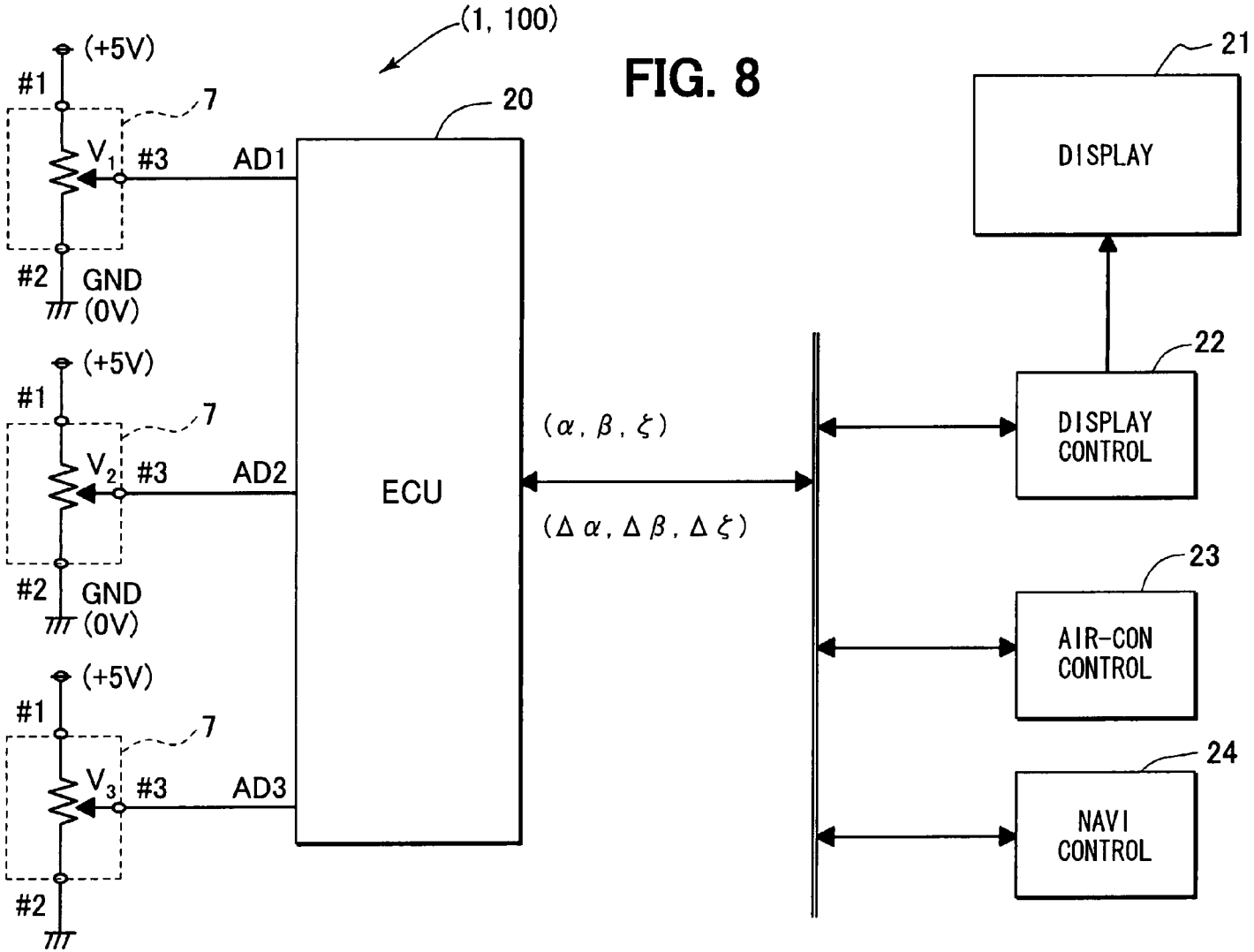
FIG. 8 is a block diagram illustrating an electrical configuration of the operation apparatus in FIG. 2.

As shown in FIG. 8, the operation apparatus 1 includes an ECU (Electronic Control Unit) 20 formed of a microcomputer, in which a given software program in ROM or the like is executed. This ECU 20 functions as a computing unit or a generation unit to generate operation output data to be explained later. The ECU 20 generates as operation output data at least data, which reflects a radial direction β around the neutral axis N in a tilt operation, based on a displacement plane DP. This displacement plane DP is defined by three three-dimensional dimensional (3-D) detected positions M1, M2, and M3 of the detection subject member 5. The three 3-D detected positions M1, M2, and M3 are determined by the ECU 20 using (i) displacement detection outputs Z, which are detection outputs of the detecting units 7 in displacements parallel with the neutral axis N and (ii) disposed position data (X, Y), which are data of disposed positions of the detecting units 7 around the neutral axis N.

Figure 1B:
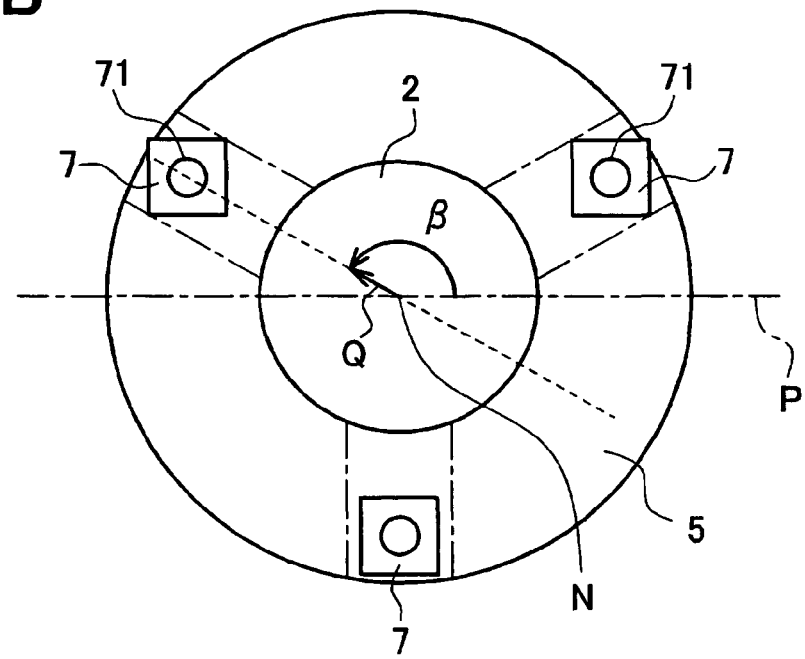
FIG. 1B is a plan view illustrating a main structure of the operation apparatus.

In the structure in FIG. 1A, the operation apparatus 1 includes a housing 9, which has a through-hole 9W in its upper ceiling. Via the through-hole 9W, a grip 4G, as one end of the operation unit 4, protrudes externally. In contrast, a support portion 2, as the other end of the operation unit 4 is disposed within the housing 9. The grip 4G and support portion 2 are coupled by a shaft portion 3 to be disposed along the basic axis Q. In other words, the disc-type detection subject member 5 protrudes from the circumferential surface of the shaft portion 3 included in the operation unit 4. The support portion 2 can be unrestrainedly tilted on a concave spherical support surface 6B of the reception unit 6 on a bottom of the housing 9. The detecting units 7 are disposed to surround the support surface 6B in a plan view of FIG. 1B.

Figure 9A:
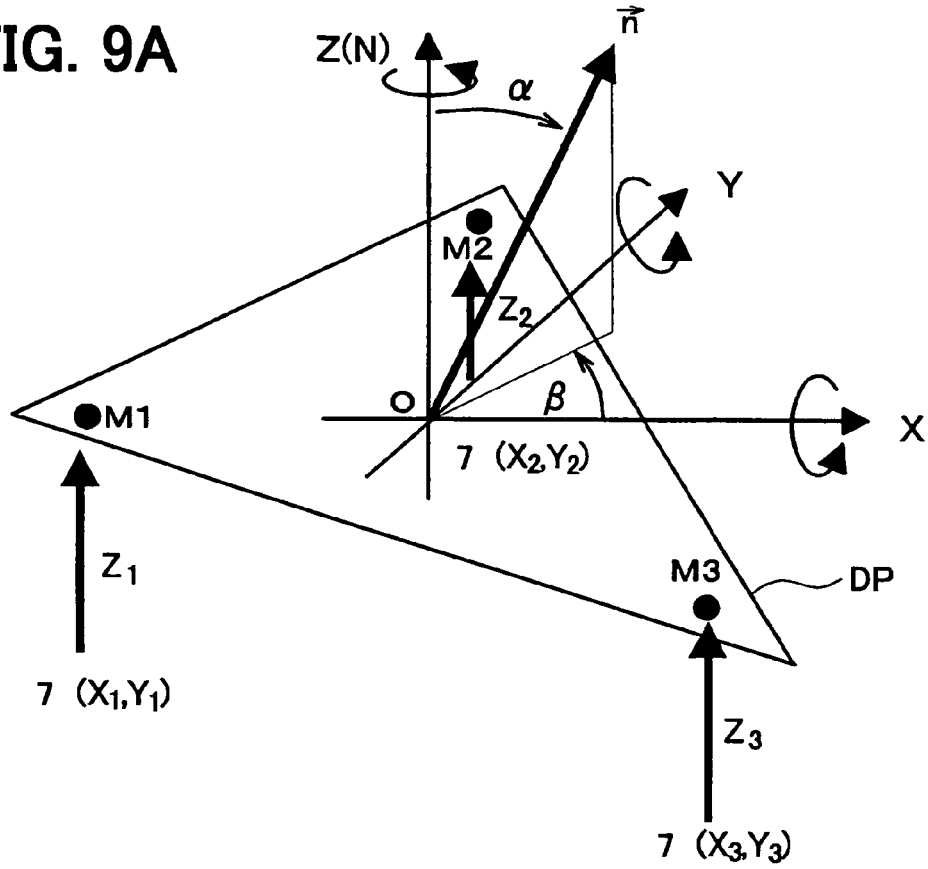
FIGS. 9A, 9B, and 9C are diagrams illustrating principles for computing operation output data.

As shown in FIG. 9A, displacements parallel with the neutral axis N of the detection subject plane 8C are detected by the three detecting units 7 according to a tilt operation of the operation unit 4. Three detected positions of the detection subject member 5 can define one plane, i.e., a displacement plane DP. This displacement plane DP is tilted accordingly as the operation unit 4 is tilted from the neutral axis N. That is, three displacement detection outputs Z1, Z2, and Z3 parallel the neutral axis N and disposed positions data (X1, Y1), (X2, Y2), and (X3, Y3) around the neutral axis N are used for the detecting units 7 to determine the 3-D detected positions M1, M2, and M3 of the detection subject member 5. Then the 3-D detected positions M1, M2, and M3 defines the displacement plane DP. Using this displacement plane DP can determine which tilt direction β a tilt operation is applied in, even when the tilt operation can be applied in more than three different tilt directions. Further, using the displacement plane DP can determine a displacement of a tilt angle α as well. The displacement of the tilt angle a is an angle displacement from the neutral axis N, i.e., a tilt operation amount.

The displacement plane DP can be determined by identifying outputs from minimally three detecting units 7; however, this does not mean that the maximum number of detecting units 7 is three. In other words, more than three detecting units 7 can be provided. In this case, a displacement plane DP can be determined without problems by selecting any three displacement detection outputs Z from the more than three detecting units 7. In this case, how to select a set of three detecting units 7 from among multiple units 7 can be determined as needed.

As explained above, tilt directions in which the operation unit 4 tilts can be provided practically stepless (i.e., with multiple steps or directions, each of which adjoins a neighboring one within a three degrees) around the neutral axis N. Otherwise, the tilt directions may be provided stepwise (e.g., with at least four steps or directions). In this case, a restriction unit can be provided mechanically to allow tilt operations in only restricted directions.

In the case where only a tilt operation is detected, an angle phase around the basic axis Q in the detection subject member 5 can be fixed. The detection subject member 5 can be provided as individual segmental members, which individually extend radially from the basic axis while having intervals (i.e., angle phases) with each other circumferentially around the basic axis Q to correspond to the detecting units 7 surrounding the neutral axis N, as shown in chain lines in FIG. 1B. In this case, the detectable plane 8C is defined as a plane including segmental planes corresponding to identical sides of the segmental members. Thus, the segmental planes are arranged to have intervals with each other circumferentially around the basic axis Q.

Figure 5B:
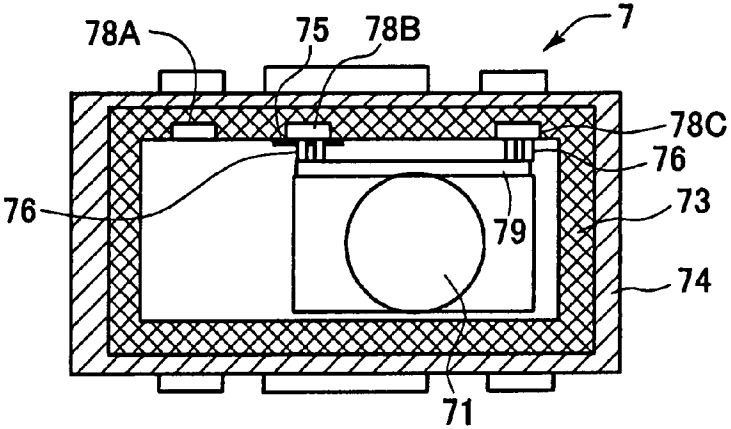
FIG. 5B is a cross-sectional plan view taken from a line VB to VB in FIG. 5A.
Figure 5C:
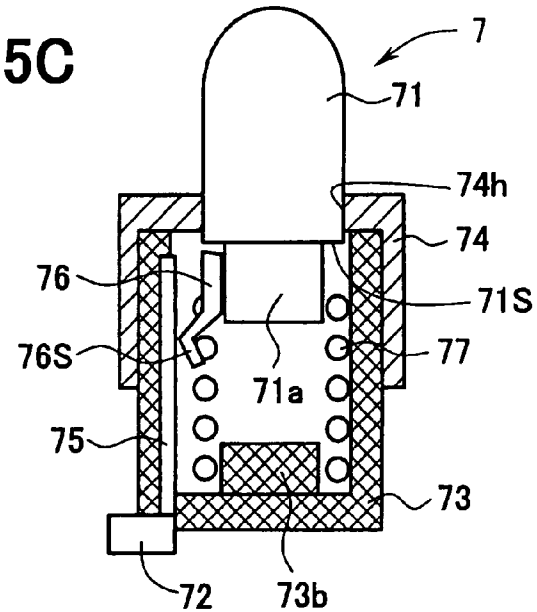
FIG. 5C is a cross-sectional view taken from a line VC to VC in FIG. 5A.
Figure 5A:
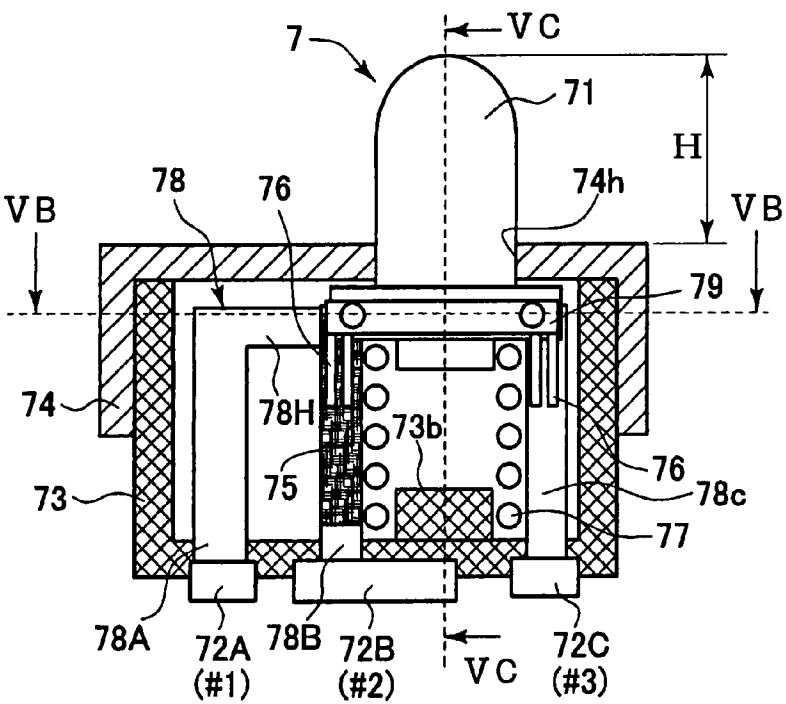
FIG. 5A is a cross-sectional front view of a linear variable resistance unit.

Referring to FIGS. 5A to 5C, each detecting unit 7 includes a movable portion 71 displaced reciprocally parallel with the neutral axis N to slidably abut to the detection subject plane 8C. This movable portion 71 thereby detects a linear displacement along or parallel with the neutral axis N by following a movement of the detection subject plane 8C. Thus, the detecting unit 7 slidably abuts to the detection subject plane 8C. The detecting unit 7 includes bias means to bias the movable portion 71 towards or onto the detection subject plane 8C.

Figure 6:
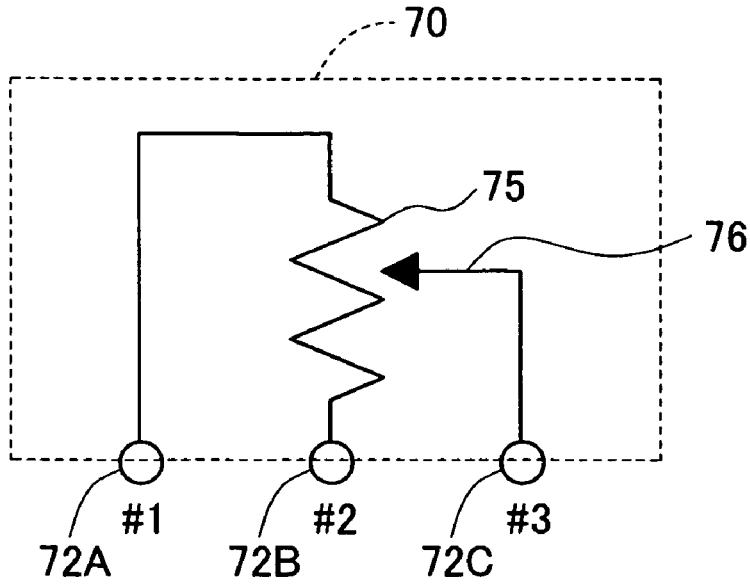
FIG. 6 is an equivalent circuit for a linear variable resistance unit.

In this embodiment, the detecting unit 7 includes (i) a slidable electric connector 76 to move integrally with the movable portion 71 parallel with the neutral axis N and (ii) a resistive conductor 75 disposed parallel with the neutral axis N such that a resistance is divided by the slidable electric connector 76 to follow the movable portion 71 displaced, as shown in FIGS. 5A to 5C. One end (terminal 72A: #1) of the resistive conductor 75 connects with a signal power (+5V); the other end (terminal 72B: #2) connects to ground. The slidable electric connector 76 (terminal 72C: #3) functions as an output point to output a partial voltage of a resistance half bridge formed by dividing the resistive conductor 75, as shown in FIG. 6.

The detecting unit 7 is provided as a linear variable resistance unit, which assembles an elastic member 77 as the bias means in addition to the movable portion 71. For instance, the detecting unit 7 includes a casing 73 having an opening in the upper side, and a cap portion 74 to cover the opening. In this explanation, the opening is in the upper side; however, the opening may not be in the upper side depending on a direction for installing the unit. Thus, explanation of positional expression such as "upper" or "lower" does not limit the direction for installing the unit.

The casing 73 is molded using resin and contains a lead frame 78 in an internal wall. The lead frame 78 is made of metal and includes multiple terminal frame portions 78A, 78B, and 78C. Of the terminal frame portion 78A, an upper end is integrated with a traverse frame portion 78H. Of the terminal frame portions 78A, 78B, and 78C, lower ends penetrate a bottom of the casing 73 to electrically connect with pads 72A, 72B, and 72C for mounting a substrate; the pads 72A, 72B, and 72C are disposed on a rear surface of the casing 73. Between the centrally located terminal frame portion 78B and the traverse frame portion 78H, a longitudinal resistive conductor 75 including a carbon film is disposed. The lead frame 78 is fixed to the casing 73 with insert molding to have a main surface even with that of the internal wall.

On a bottom of the casing 73, a protruding portion 73*b* is provided to locate and fix the lower end of a coil spring of the elastic member 77.

The upper end of the elastic member or coil spring 77 abuts to the movable portion 71.The movable portion 71 is molded with resin to have a spherical upper portion and a cylindrical body. The upper portion abuts to the detection subject plane 8C. Of the body, the lower end has a shortened diameter to be inserted via the upper end of the coil spring 77.

The upper end of the movable portion 71 protrudes upwardly from the through-hole 74*h* of the cap portion 74; the lower end connects at its side with the slidable frame 79. At both ends of the slidable frame 79, slidable electric connectors 76 are formed to vertically slidably abut to the resistive conductor 75 and the terminal frame portion 78C, respectively. The slidable frame 79 and slidable electric connectors 76 are made of metal, e.g., beryllium copper or phosphor bronze, for springs. Each of the slidable electric connectors 76 is shaped of strips extending downwardly from one end of the slidable frame 79 while a bent spring portion in a longitudinal intermediate point elastically abuts to the resistive conductor 75 or terminal frame portion 78C.

Figure 7:
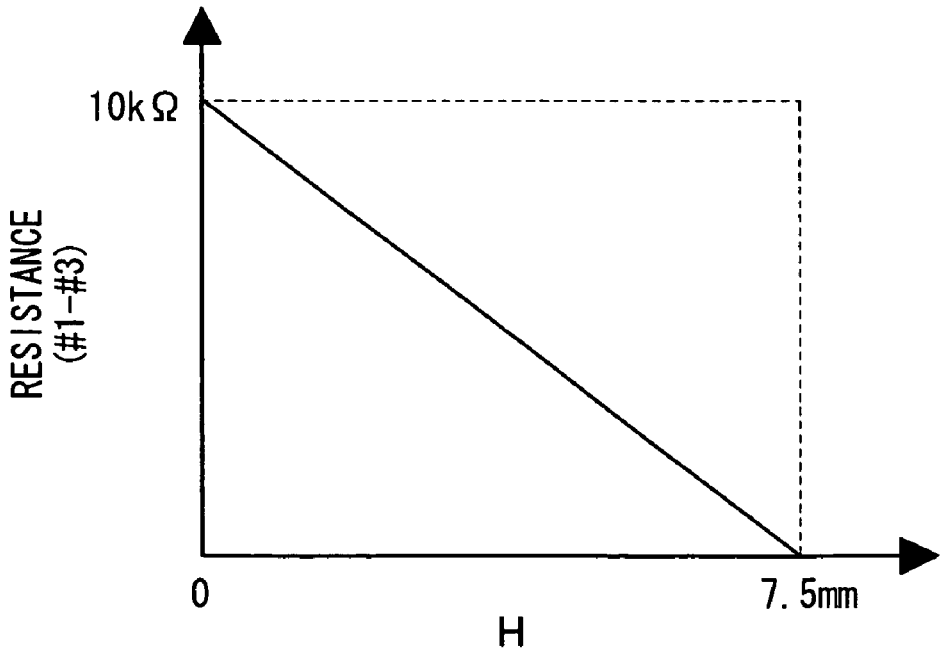
FIG. 7 is a diagram illustrating an example of operation characteristics of the linear variable resistance unit.

An operation applied to the operation unit 4 moves the movable portion 71 to cause the slidable electric connectors 76 to divide the resistive conductor 75 with the division ratio unambiguously corresponding to the position of the movable portion 71. This allows a partial voltage or resistance at the pad 72C to linearly vary as shown in FIG. 7. In this embodiment, a nominal resistance of the resistive conductor 75 is 10 k ohm, while the maximum extended displacement of the movable portion 71 is 7.5 mm.

(Modifications for Detecting Unit)

Figure 11:
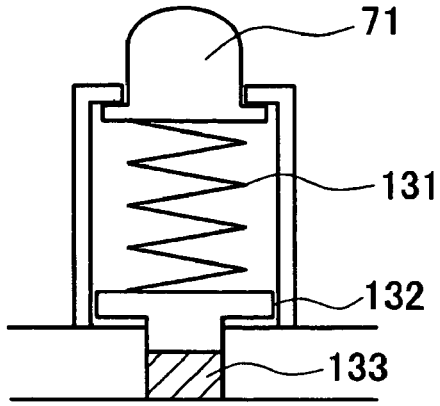
FIG. 11 is a cross-sectional front view of a modification of a detecting unit.

The detecting unit 7 may be another type other than the linear variable resistance unit. In FIG. 11, a load sensor 133 is used to detect a displacement. The load sensor may include a piezoelectric element, a capacitor varying capacitance depending on loads, or a strain gauge. Movement or displacement of the movable portion 71 compresses and deforms an elastic member 131 in FIG. 11. The elastic force of the elastic member 131 is transmitted to the load sensor 133. In other words, the load sensor 133 detects the elastic force generated in the elastic member 131 based on the movement of the movable portion 71. Thus, the displacement of the movable portion 71 is reflected on an output value of the load sensor 133. Between the load sensor 133 and elastic member 131, a spring shoe member 132 is provided.

Figure 12:
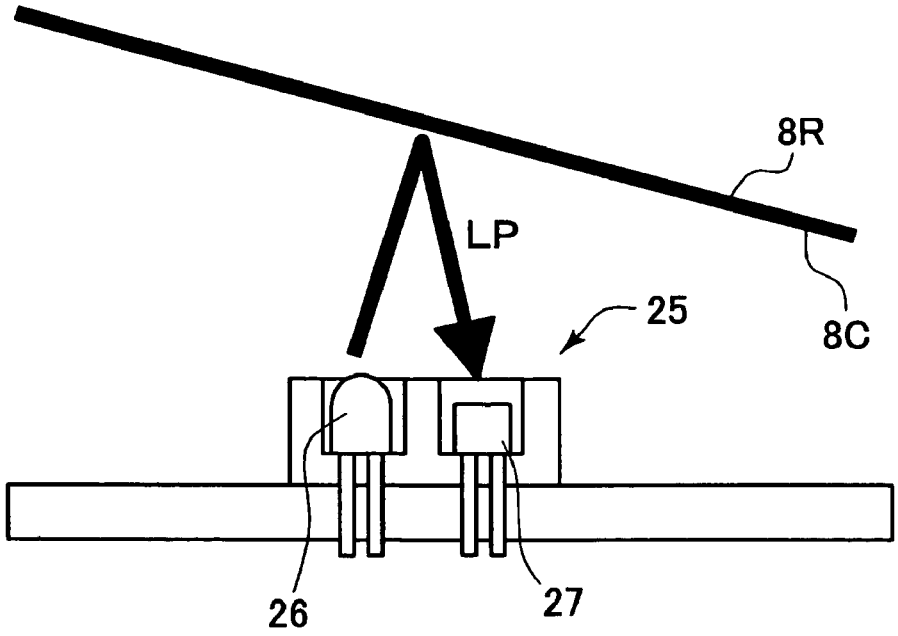
FIG. 12 is a cross-sectional front view of another modification of a detecting unit.

In FIG. 12, the detection subject plane 8C has a reflection mirror 8R made of a metal film; an optical distance sensor 25 detects a position of the detection subject plane 8C based on reflection lights. The optical distance sensor 25 radiates laser pulses LP from a projection portion 26 towards the reflection mirror 8R and receives the reflected pulses via a reception portion 27 to measure a distance to the detection subject plane 8C using a reflection time period of the laser pulses LP.

Figure 13:
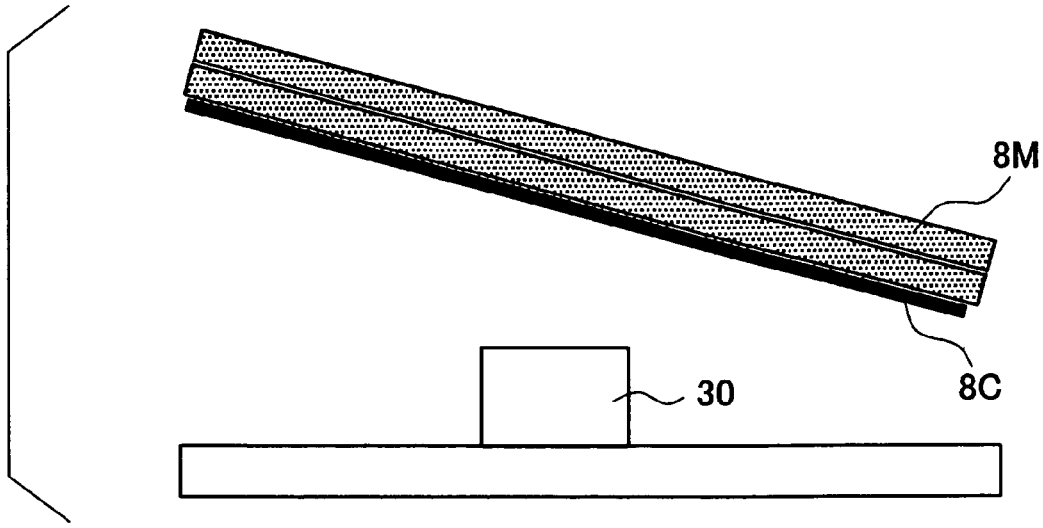
FIG. 13 is a cross-sectional front view of yet another modification of a detecting unit.

In FIG. 13, the detection subject plane 8C includes a permanent magnet 8M. A magnetic field detection element 30 such as a hall element or magnetic head detects a magnetic field strength to measure a distance to the detection subject plane 8C.

Figure 9B:
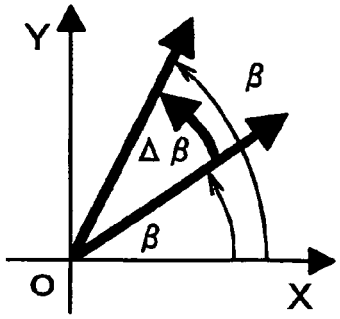
Figure 9C:
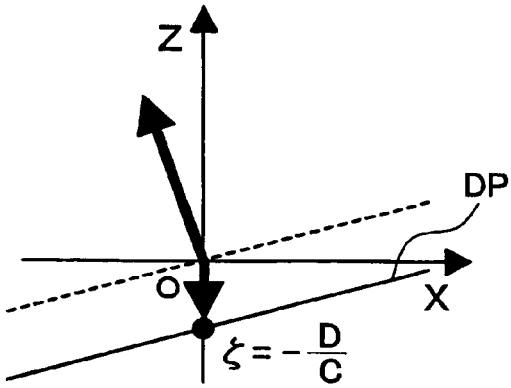

Next, a computation process for determining a tilt direction β and tilt angle α will be explained below. As shown in FIGS. 9A to 9C, a displacement detection axis Z is defined parallel with the neutral axis N and a coordinate plane X-Y is defined to indicate the disposed positions of the detecting units 7. Thus, a 3-D coordinate space X-Y-Z is defined. In this 3-D coordinate space X-Y-Z, the 3-D detected positions of the detection subject plane 8C are represented as three sets of space coordinates M1, M2, and M3 based on the three displacement detection data or outputs (Z1, Z2, Z3) and the coordinate data (X1, Y1), (X2, Y2), and (X3, Y3) of the fixed disposed positions of the detecting units 7. Next, a normal line vector n for a plane defined by the space coordinates M1, M2, and M3 is computed as data for the above-mentioned displacement plane DP to thereby generate or compute operation output data reflecting a tilt direction β around the neutral axis N and a tilt angle α with respect to the neutral axis N, wherein the tilt direction β and tilt angle α result from a tilt operation.

(Equation 1)

An equation to define a plane including $M1(X1, Y1, Z1)$, $M2(X2, Y2, Z2)$, and $M3(X3, Y3, Z3)$ $$A(X - X1) + B(Y - Y1) + C(Z - Z1) = 0 \tag{1}$$

$$AX + BY + CZ + D = 0 \text{ Normal line vector } \vec{n} = (A, B, C) \tag{2}$$

$$A = \begin{vmatrix} Y2 - Y1 & Z2 - Z1 \\ Y3 - Y1 & Z3 - Z1 \end{vmatrix} \tag{3}$$

$$B = \begin{vmatrix} Z2 - Z1 & X2 - X1 \\ Z3 - Z1 & X3 - X1 \end{vmatrix} \tag{4}$$

$$C = \begin{vmatrix} X2 - X1 & Y2 - Y1 \\ X3 - X1 & Y3 - Y1 \end{vmatrix} \tag{5}$$

$$D = -AX1 - BY1 - CZ1 \tag{6}$$

(Equation 2)

$$X = r\sin\alpha\cos\beta \tag{7}$$

$$Y = r\sin\alpha\sin\beta \tag{8}$$

$$Z = r\cos\alpha \tag{9}$$

$$r = \sqrt{X^2 + Y^2 + Z^2} \tag{10}$$

$$\alpha = \mathrm{Sin}^{-1}\frac{Z}{r} \tag{11}$$

$$\beta = \mathrm{Tan}^{-1}\frac{Y}{X} \tag{12}$$

When a determined plain is expressed by (2), $$\alpha = \mathrm{Sin}^{-1}\frac{C}{\sqrt{A^2 + B^2 + C^2}} \tag{13}$$

$$\beta = \frac{B}{A} \tag{14}$$

$$\xi = -\frac{D}{C} \tag{15}$$

Figure 14:
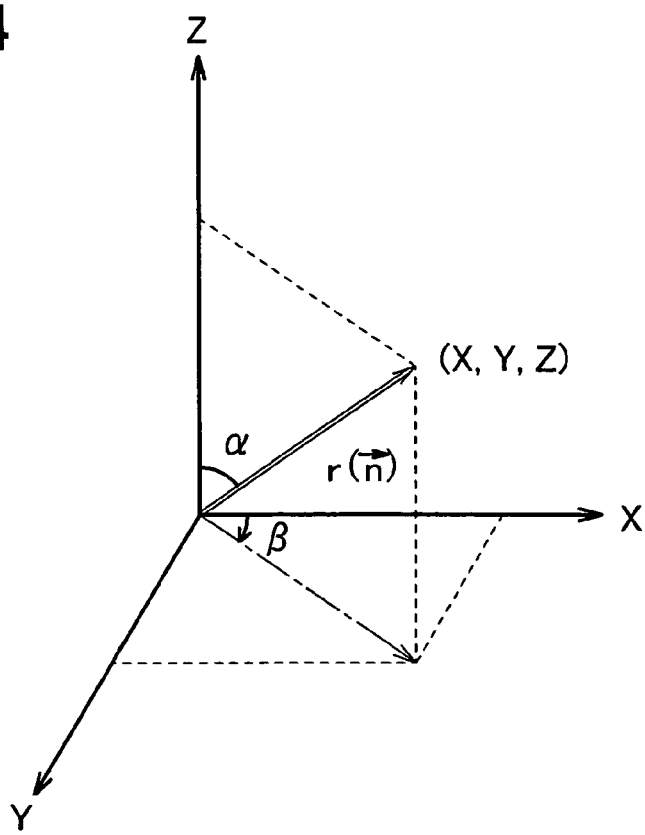
FIG. 14 is a diagram illustrating definitions of a tilt angle and a tilt direction.

Here, α and β are illustrated in FIG. 14.

An equation of a plane including the space coordinates M1, M2, and M3 is expressed by Formula (1) of Equation 1. A plane is generally expressed by Formula (2), which is obtained by developing Formula (1). A vector having components of coefficients A, B, C of coordinate variables X, Y, Z is a normal line vector n for the displacement plane DP. A direction of the normal line vector n for the displacement plane DP accords with the basic axis Q in the structure in FIG. 1. The vector components A, B, and C of the normal line vector n can be computed using Formulas (3), (4), and (5) from correspondence relationship between Formulas (1) and (2).

A coordinate point (X, Y, Z) is expressed in a polar coordinate system as shown in Formulas (7), (8), (9) of Equation 2 by using a radius r, a tilt angle $\alpha$ from Z axis, a tilt direction $\beta$ formed between X axis and an orthogonal projection to X-Y plane of the radius r. From Formulas (7), (8), and (9), the radius r, the tilt angle $\alpha$, and tilt direction $\beta$ are expressed by Formulas (10), (11), and (12). Assume that the radius r is regarded as the normal line vector n. If the components A, B, C of the normal line vector n computed using Formulas (3), (4), and (5) are substituted to X, Y, Z in Formulas (10), (11), and (12), the tilt angle $\alpha$ and tilt direction $\beta$ can be computed using Formulas (13) and (14).

Here, as indicated by the above formulas, the tilt angle $\alpha$ and tilt direction $\beta$ are unambiguously determined based on the space coordinates M1 (X1, Y1, Z1), M2 (X2, Y2, Z2), and M3 (X3, Y3, Z3) from a geometric principle of the displacement plane DP. X-Y coordinate data (X1, Y1), (X2, Y2), and (X3, Y3) corresponding to the disposed positions of the three detecting units 7 are fixed, so that the tilt angle $\alpha$ and tilt direction $\beta$ can be expressed by functions having independent variables of Z1, Z2, and Z3. Thus, $$\alpha=\alpha(Z1, Z2, Z3) \tag{16}$$

$$\beta=\beta(Z1, Z2, Z3) \tag{17}$$

Therefore, the values of $\alpha$ and $\beta$ can be computed using values of Z1, Z2, and Z3 based on the above computation algorithm. Further, they can be determined with reference to a 3-D table, in which values of $\alpha$ and $\beta$ corresponding to various values of Z1, Z2, and Z3 are previously computed and stored.

In this case, the algorithm to determine values of $\alpha$ and $\beta$ does not seem to directly include a step to compute a displacement plane DP; however, values of $\alpha$ and $\beta$ included in the table are equal to values computed using various corresponding values of Z1, Z2, and Z3 based on the above computation algorithm (or mathematically equivalent algorithm) of the geometric principle about the displacement plane DP.

(Modification for Operation Apparatus)

Figure 3:
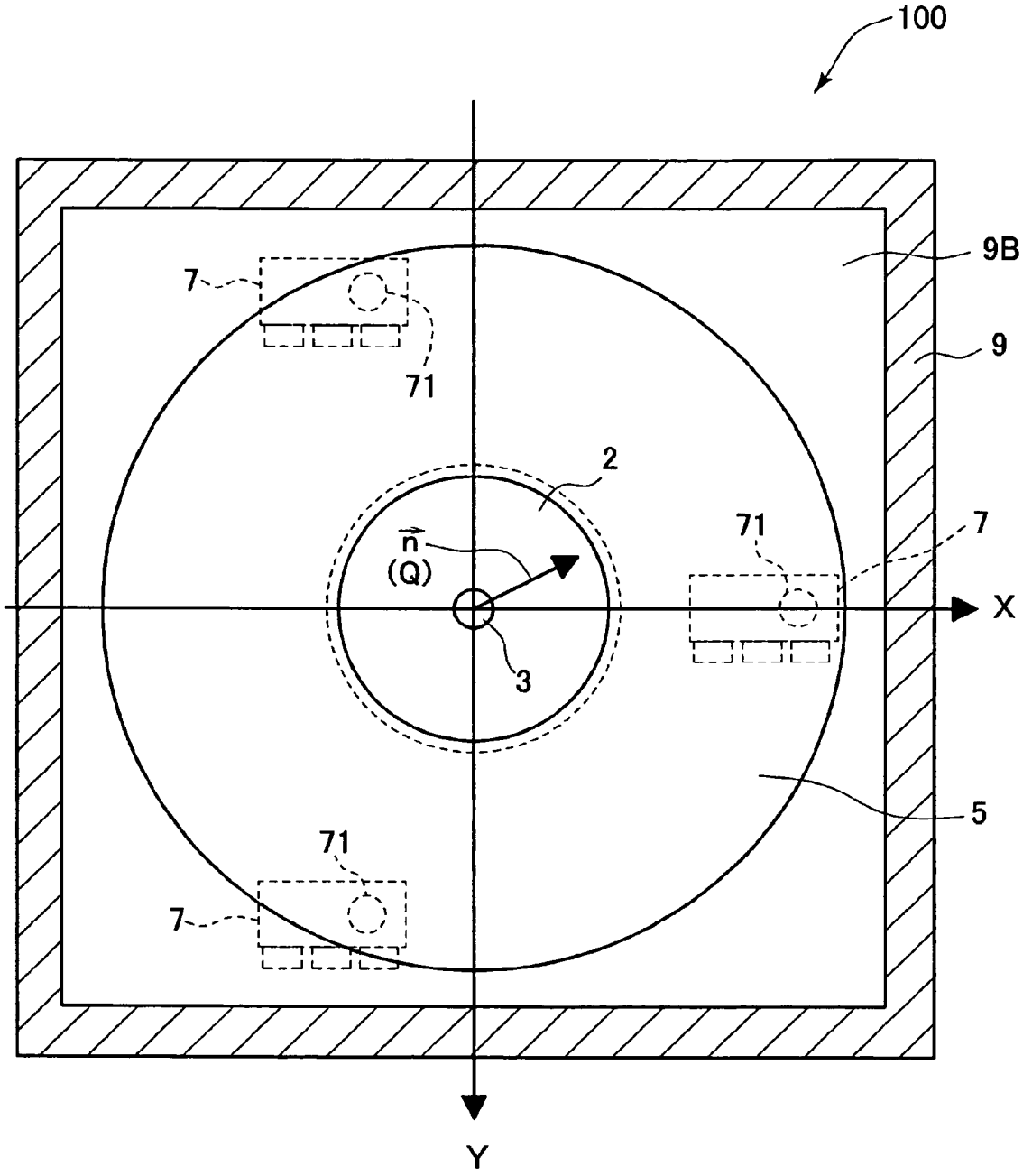
FIG. 3 is a plan view illustrating a main structure of the operation apparatus in FIG. 2.
Figure 4:
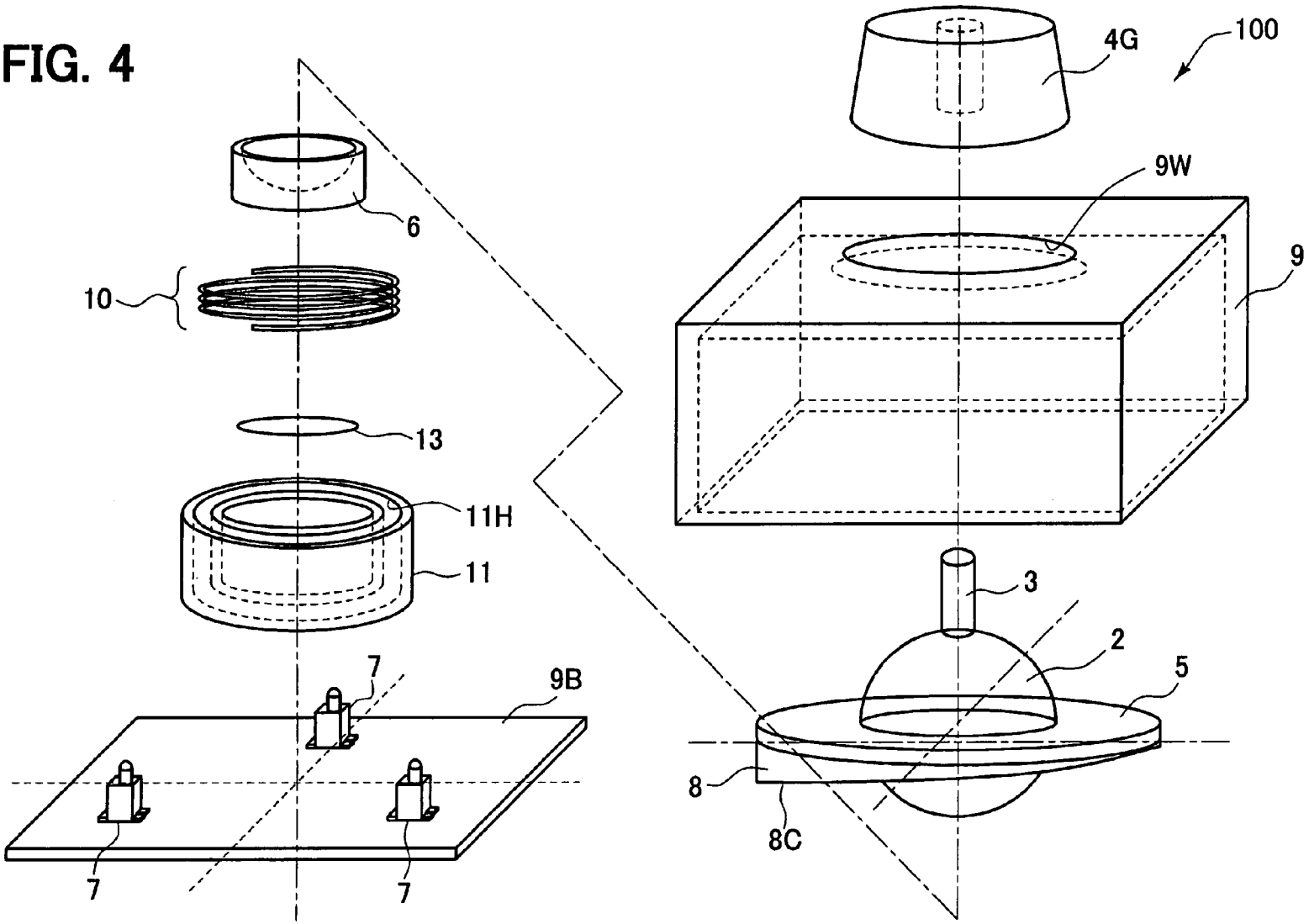
FIG. 4 is a perspective exploded view of the operation apparatus in FIG. 2.

Next, a modified operation apparatus 100 will be explained with reference to FIGS. 2, 3, and 4. This operation apparatus 100 includes an additional function compared to the operation apparatus 1. The basic structure of the apparatus 100 is similar to that of the apparatus 1; therefore, common components are assigned identical reference numbers and not explained repeatedly. Main differences will be explained below.

A detection subject member 5 of the apparatus 100 has a detection subject plane 8C, which is uninterruptedly formed to surround a basic axis Q and tilted with a predetermined angle relative to a basic plane L orthogonal to the basic axis Q. An operation unit 4 can be rotated around the basic axis Q assuming that the basic axis Q accords with the neutral axis N. The basic axis Q is an axis of the operation unit 4 and accords with the neutral axis N in a neutral state, i.e., without external operational force applied. This neutral state is illustrated in a cross-sectional view of the apparatus 100 of FIG. 2.

The detection subject plane 8C is designed to be initially tilted relative to the basic plane L, which is orthogonal to the basic axis Q, with an initial tilt angle $\alpha$0. In this case, when the operation unit 4 is rotated in the neutral state, the detection subject plane 8C changes its tilt direction $\beta$ according to an angle of the rotation of the operation unit 4 around the basic axis Q and neutral axis N. This change in the tilt direction can be detected by detecting units 7; therefore, the ECU 20 can generate operation output data reflecting a displacement of the tilt direction $\beta$, i.e., rotational displacement $\Delta\beta$ around the neutral axis N, based on displacement detection outputs Z of the detecting units 7, as shown in FIG. 9B.

When the operation unit 4 receives a tilt operation displacement, the detection subject plane 8C increases a tilt angle corresponding to the displacement. A displacement plane DP determined using positions M1, M2, and M3 detected by the three detecting units 7 is tilted with an initial tilt angle $\alpha$0 at an initial tilt direction $\beta$0 with respect to the basic plane L in the neutral state, i.e., with the basic axis Q according with the neutral axis N. In other words, the normal line vector n for the displacement plane DP is biased in the tilt angle $\alpha$ and tilt direction $\beta$ by a value of the initial tilt angle $\alpha$0 and a value of the initial tilt direction $\beta$0, respectively, with the operation unit 4 maintained in the neutral state.

When a rotation operation is applied to the operation unit 4 in the neutral state, the tilt angle $\alpha$ and tilt direction $\beta$ are changed in a manner different from a manner when a tilt operation is applied. That is, with a rotation operation applied, the normal line vector n for the displacement plane DP maintains the tilt angle $\alpha$ at the initial tilt angle $\alpha$0, but increases the tilt direction $\beta$ by an angle corresponding to the rotation operation from the initial tilt direction $\beta$0. This allows a determination as to whether an operation applied to the operation unit 4 is a tilt operation or rotation operation.

When a tilt operation is applied, a tilt angle $\alpha$ and tilt direction $\beta$ change independently of each other. When a rotation operation is applied, a tilt angle $\alpha$ is substantially maintained at the initial tilt angle $\alpha$0. This relationship is used as below. Displacement detection outputs Z of the detecting units 7 are periodically sampled and subjected to the above-mentioned Formulas (13) and (14) to compute a tilt angle $\alpha$ and tilt direction $\beta$ and to monitor variations or displacement amounts from the initial values of $\alpha$0 and $\beta$0, respectively. When both a displacement amount of the monitored tilt angle $\alpha$ from the initial value of $\alpha$0 and a displacement amount of the monitored tilt direction $\beta$ from the initial value of $\beta$0 exceed from individual predetermined values, it is determined that a tilt operation is applied. When a displacement amount of the monitored tilt angle $\alpha$ from the initial value of $\alpha$0 remains within the predetermined value and a displacement amount of the monitored tilt direction $\beta$ from the initial value of $\beta$0 exceeds from the predetermined value, it is determined that a rotation operation is applied.

Next, the operation unit 4 of the operation apparatus 100 can receive a press operation in the neutral state. The ECU 20 generates operation output data reflecting press operation displacement in the neutral axis N based on the three displacement detection outputs Z. The operation apparatus 1 can be enhanced in its functionality by adding detection or recognition of press operation.

Figure 2:
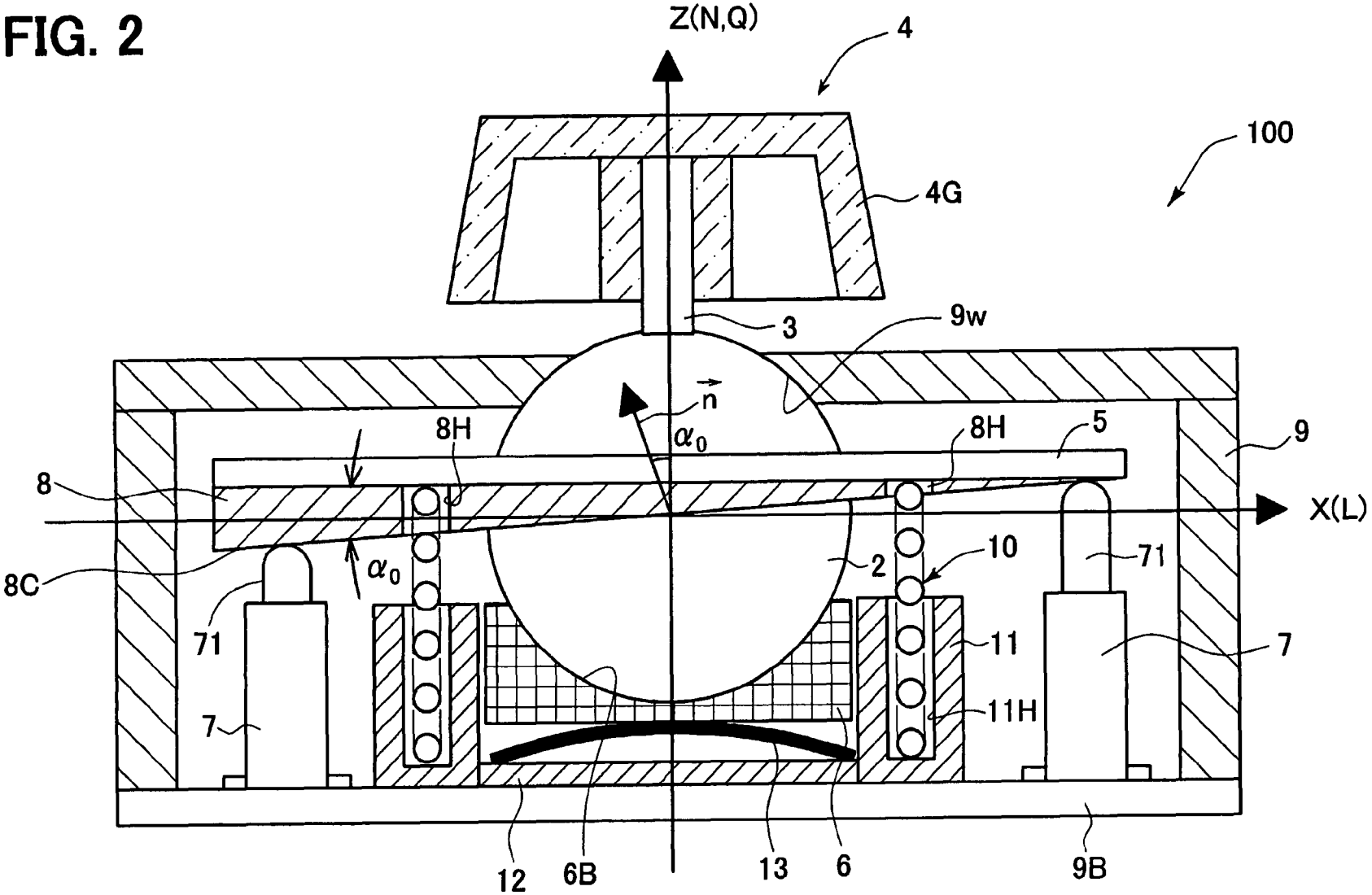
FIG. 2 is a cross-sectional front view of an operation apparatus as a modification.

A reception unit 6 is installed to float with a necessary gap over a bottom 9B of a housing 9 via elastic members 10, 13, as shown in FIG. 2. The elastic members 10, 13 bias and press a spherical support portion 2 towards the periphery of a through-hole 9W of the housing 9. When a press operation force in the neutral axis N is applied to the operation unit 4, the support portion 2 is downwardly pressed against biasing force from the elastic members 10, 13. Thus, three detecting units 7 undergo press displacements having identical strokes. Detecting the press displacements allows a determination as to whether a press operation is applied to the operation unit 4 or not.

In this case, the displacement plane DP is moved parallel with Z axis, as shown in FIG. 9C. This parallel movement is computed from Z axis section $\zeta(=-D/C)$ in Formula (15) in the plane expressed by Formula (1).

When a tilt operation is applied to the support portion 2, a press operation force is not applied. A tilt operation is applied to the support portion 2 with the support portion 2 pressed to the periphery of the through-hole 9W by the elastic members 10, 13. The periphery of the through-hole 9W has a concave spherical surface to allow the support portion 2 to smoothly slide on the periphery of the through-hole 9W. Further, a disc-shaped detection subject member 5 is designed to protrude from a circumferential surface of the support portion 2 since the support portion 2 is directly pressed to the periphery of the through-hole 9W. To form a tilted detection subject member 8C, a detection subject plane forming layer 8 is integrated into the rear surface of the disc-shaped detection subject member 5. The detection subject plane forming layer 8 has a thickness, which increases in the tilt direction.

When a tilt operation is applied to the operation unit 4, the elastic member 10 receives lateral press displacement biased in the tilt operation. When the tilt operation is released, the elastic member 10 returns the operation unit 4 to the neutral position using restoring elastic force. The elastic member 10 is compressed to be contained between the bottom 9B of the housing 9 and the detection subject member 5. This structure stabilizes a tilt operation by pressing the support portion 2 onto the periphery of the through-hole 9W.

To allow rotation of the operation unit 4, the elastic member 10 is constructed as a coil spring surrounding the operation unit 4 or support portion 2. At least one end in the neutral axis N of the coil spring can be frictionally rotated with respect to the detection subject member 5 or the housing 9. In this embodiment, the top portion of the coil spring 10 is contained in a ring-shaped support groove 8H in a rear surface of the detection subject member 5. The bottom portion is in a support groove 11H of a spring support unit 11 on a bottom 9B of the housing 9. These support grooves 8H, 11H determine positions for assembling the coil spring 10 and help prevent the coil spring 10 from being displaced when the coil spring 10 rotates around the neutral axis N as the detection subject member 5 rotates. The spring support unit 11 or support groove 11H is constructed to contain a portion exceeding 50% from the bottom end of the spring 10 in height to maintain an adequate stoke of the spring 10. This prevents the spring 10 from undergoing excessive compression when compression force due to a press operation is applied. In contrast, to allow lateral displacement due to the tilt operation, the contained portion does not exceed 75%.

The elastic member 13 is a bent plate spring disposed between the reception unit 6 and a bottom 9B of the housing 9 to also provide a responsive force to a press operation of the operation unit 4. In this embodiment, the bottom 9B of the housing 9 is constructed of a substrate, on which the detecting units 7 are mounted. Between the bottom 9B and the elastic member or plate spring 13, a protection plate 12 is inserted to protect the substrate.

Figure 10:
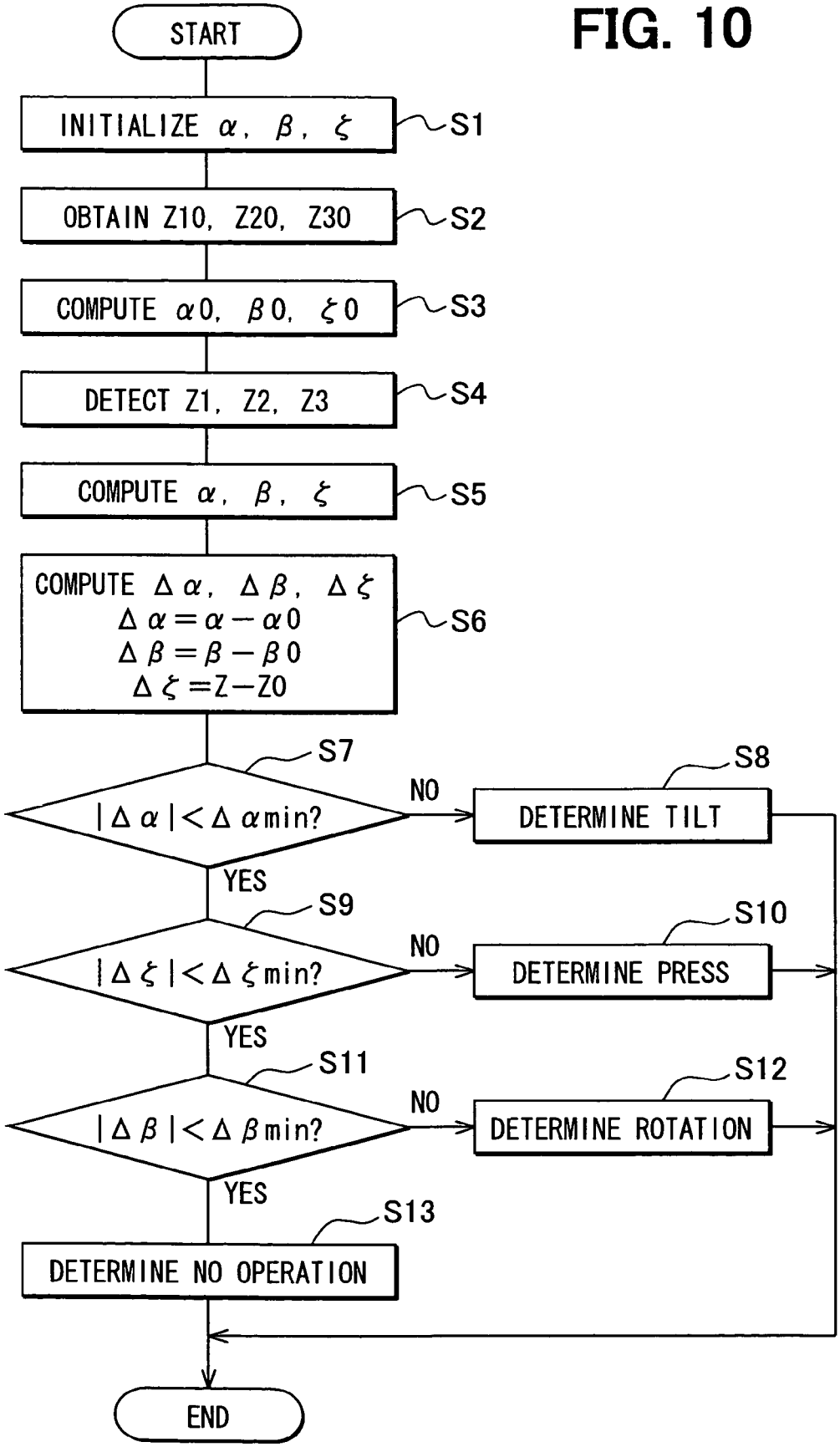
FIG. 10 is a flowchart diagram illustrating an example of a process for computing operation output data in the operation apparatus in FIG. 2.

FIG. 8 is a block diagram illustrating an electrical configuration of the operation apparatus 100. The ECU 20 has individual A/D conversion ports for inputting output voltages of the above-mentioned detecting units 7. The ECU 20 generates operation output data using a control software program stored in the internal ROM. FIG. 10 shows a flowchart for generating the operation output data.

At S1, memory values for $\alpha$, $\beta$, and $\xi$ stored in the RAM of the ECU 20 are initialized (cleared). At S2, initial values Z10, Z20, and Z30 of displacement detection output values are obtained. For instance, the initial values Z10, Z20, and Z30 are previously detected while the operation unit 4 is maintained in the neutral state (without tilt or press operation applied) with a rotational angle phase set to a predetermined initial angle phase and stored in the ROM or the like as parameters unique to the apparatus 100. At S3, using the initial values Z10, Z20, and Z30, initial values of $\alpha$0, $\beta$0, and $\xi$0 are computed from Formulas (13), (14), and (15) and stored in individual memory areas of $\alpha$, $\beta$, and $\xi$.

Further, the initial values of $\alpha$0, $\beta$0, and $\xi$0 may be previously stored in the ROM or the like as parameters unique to the apparatus. In this case, only reading out the initial values of $\alpha$0, $\beta$0, and $\xi$0 and loading them in the memory areas are required without necessity of computation for obtaining the initial values of $\alpha$0, $\beta$0, and $\xi$0 using Z10, Z20, and Z30.

At S4, current displacement detection outputs Z1, Z2, and Z3 are obtained from the individual detecting units 7. At S5, corresponding values of $\alpha$, $\beta$, and $\xi$ are computed and stored. At S6, displacement amounts of $\Delta\alpha$, $\Delta\beta$, and $\Delta\xi$ are computed as differences between the computed values of $\alpha$, $\beta$, and $\xi$ and the initial values of $\alpha$0, $\beta$0, and $\xi$0. At S7, it is determined whether a tilt angle displacement $\Delta\alpha$ is smaller than a lower limit value $\Delta\alpha$min. Only when a tilt operation is applied, a remarkable displacement appears in $\Delta\alpha$. When $\Delta\alpha$ is not smaller, a tilt operation is determined to be applied, which advances the sequence to S8. At S8, $\Delta\alpha$ and $\Delta\beta$ are outputted as operation amounts in the tilt angle and the tilt direction, respectively.

Instead, when $\Delta\alpha$ is smaller than $\Delta\alpha$min, the sequence goes to S9. At S9, it is determined whether $\Delta\xi$ is smaller than a predetermined lower limit value $\Delta\xi$min. When $\Delta\xi$ is not smaller, a press operation is determined to be applied, which advances the sequence to S10. At S10, $\Delta\xi$ is outputted as an operation amount in the press operation (or as a bit output representing whether a press operation is applied or not).

When $\Delta\xi$ is smaller than the lower limit $\Delta\xi$min, the sequence goes to S11. At S11, it is determined whether $\Delta\beta$ is smaller than a predetermined minimum value $\Delta\beta$min. When $\Delta\beta$ is not smaller, a rotation operation is determined to be applied, which advances the sequence to S12. At S12, $\Delta\beta$ is outputted as an operation amount in the rotation operation. When $\Delta\beta$ is smaller than the lower limit value $\Delta\beta$min, the sequence goes to S13, where no operation is determined to be applied. Further, when $\Delta\xi$ is smaller than the lower limit $\Delta\xi$min, steps S11 to S13 may be replaced with the following: $\Delta\beta$ is outputted as a current rotation angle phase of the operation unit 4 regardless of whether a rotation operation is applied or not.

Thus obtained operation output data is distributed to various devices, which use the operation output data, via a data communications line. For instance, in a display device 21 such as an LCD or EL panel of a navigation apparatus, a movement direction of a pointer can be designated by a tilt direction. In this case, $\Delta\beta$ relating to a tilt direction in a tilt operation is distributed to a control circuit 22 for the display device 21 or to a control circuit 24 of the navigation apparatus.

Further, $\Delta\alpha$ relating to a tilt angle displacement or tilt operation amount may correspond to a movement speed of the pointer. In contrast, $\Delta\xi$ relating to a press operation may be used for determining a position of the pointer. Further, $\Delta\beta$ relating to a rotation operation may correspond to an instructed value for setting a temperature, air volume, or blowing outlet in an air-conditioner control circuit 24.

Further, the operation apparatus may be used as a sound volume control, a jog dial for selecting a song (e.g., a song is determined by a press operation), or a dial for selecting a radio broadcast.

Each or any combination of processes, steps, or means explained in the above can be achieved as a software unit (e.g., subroutine) and/or a hardware unit (e.g., circuit or integrated circuit), including or not including a function of a related device; furthermore, the hardware unit can be constructed inside of a microcomputer.

Furthermore, the software unit or any combinations of multiple software units can be included in a software program, which can be contained in a computer-readable storage media or can be downloaded and installed in a computer via a communications network.

It will be obvious to those skilled in the art that various changes may be made in the above-described embodiments of the present invention. However, the scope of the present invention should be determined by the following claims.

What is claimed is:

1. An operation apparatus comprising:

an operation unit for a user to hold to perform an operation including a tilt operation, wherein a basic axis of the operation unit tilts in a certain radial direction among at least four radial directions with respect to a neutral axis;

a detectable member having a detectable plane, which intersects with the basic axis and makes a movement integrated with the operation of the operation unit;

a displacement detector having three detecting units fixed in disposed positions surrounding the neutral axis for detecting displacement, which is generated by the movement of the detectable plane and parallel with the neutral axis; and a computing unit for computing operation output data indicating the certain radial direction, in which the operation unit tilts, by using (i) the disposed positions of the three detecting units and (ii) the displacement which is generated by the movement of the detectable plane and detected by the displacement detector, wherein the detectable member is constructed of segmental members, which individually extend radially from the basic axis while having intervals with each other circumferentially around the basic axis to individually correspond to the detecting units, the detectable plane is defined as a plane including segmental planes, each of which corresponds to an identical side of one of the segmental members, and the segmental planes are arranged to have intervals with each other circumferentially around the basic axis.

2. The operation apparatus of claim 1, wherein the basic axis tilts in the certain radial direction among the at least four radial directions with respect to the neutral axis with a tilt center, at which the basic axis and the neutral axis intersect with each other, functioning as a supporting point.

3. The operation apparatus of claim 2, further comprising:

a reception unit for supporting the operation unit and allowing the basic axis to tilt in the certain radial direction among the at least four radial directions with respect to the neutral axis with the tilt center functioning as the supporting point.

4. The operation apparatus of claim 3, wherein the reception unit supports the operation unit and allows the basic axis to tilt in any radial direction with respect to the neutral axis with the tilt center functioning as the supporting point.

5. The operation apparatus of claim 1, wherein the detectable member is shaped of a disc outwardly extending from the operation unit to intersect with the basic axis, and the detectable plane is arranged on one side of the disc to uninterruptedly surround the basic axis.

6. The operation apparatus of claim 1, wherein the displacement detector has more than three detecting units fixed in individual disposed positions surrounding the neutral axis, and three detecting units are selected from the more than three detecting units for detecting the displacement.

7. The operation apparatus of claim 1, wherein the computing unit computes operation output data indicating a tilt angle displacement of the basic axis with respect to the neutral axis, the tilt angle being generated based on the tilt operation, by using (i) the disposed positions of the three detecting units and (ii) the displacement which is generated by the movement of the detectable plane and detectable by the displacement detector.

8. The operation apparatus of claim 1, wherein the operation unit receives a press operation parallel with the neutral axis while the basic axis accords with the neutral axis, and the computing unit computes operation output data indicating a press displacement by using the displacement, which is generated by movement of the detectable plane, the movement being resulting from the press operation, and detected by the displacement detector.

9. An operation apparatus comprising:

an operation unit for a user to hold to perform an operation including a tilt operation, wherein a basic axis of the operation unit tilts in a certain radial direction among at least four radial directions with respect to a neutral axis;

a detectable member having a detectable plane, which intersects with the basic axis and makes a movement integrated with the operation of the operation unit;

a displacement detector having three detecting units fixed in disposed positions surrounding the neutral axis for detecting displacement, which is generated by the movement of the detectable plane and parallel with the neutral axis; and a computing unit for computing operation output data indicating the certain radial direction, in which the operation unit tilts, by using (i) the disposed positions of the three detecting units and (ii) the displacement which is generated by the movement of the detectable plane and detected by the displacement detector, wherein the detectable plane uninterruptedly surrounds the basic axis;

the detectable plane is tilted in a predetermined radial direction with respect to a basic plane, for which a normal line vector is the basic axis;

the operation unit performs a rotation operation around the basic axis while the basic axis accords with the neutral axis;

the computing unit computes operation output data indicating a displacement of the rotation operation, based on the displacement detected by the displacement detector;

each of the three detecting units of the displacement detector includes a movable portion to reciprocate parallel with the neutral axis while abutting to the detectable plane, the displacement detector detects a linear displacement parallel with the neutral axis to follow the movement of the detectable plane by using the movable portion of the each of the three detecting units; and the displacement detector includes a slidable electric connector, which moves parallel with the neutral axis integrally with the movable portion of the each of the three detecting units, and a variable resistor including a resistive conductor with a resistance, which is divided in a direction parallel with the neutral axis by the electric connector.

10. The operation apparatus of claim 9, wherein the displacement detector includes a bias unit that biases the movable portion of the each of the three detecting units onto the detectable plane.

11. An operation apparatus comprising:

an operation unit for a user to hold to perform an operation including a tilt operation, wherein a basic axis of the operation unit tilts in a certain radial direction among at least four radial directions with respect to a neutral axis;

a detectable member having a detectable plane, which intersects with the basic axis and makes a movement integrated with the operation of the operation unit;

a displacement detector having three detecting units fixed in disposed positions surrounding the neutral axis for detecting displacement, which is generated by the movement of the detectable plane and parallel with the neutral axis; and a computing unit for computing operation output data indicating the certain radial direction, in which the operation unit tilts, by using (i) the disposed positions of the three detecting units and (ii) the displacement which is generated by the movement of the detectable plane and detected by the displacement detector, wherein each of the three detecting units is fixed in a disposed position to detect as a displacement detection output a displacement, which is generated by the movement of the detectable plane and parallel with the neutral axis, and the computing unit determines three three-dimensional detected positions, at which the three detecting units abut to and detect the detectable plane, by using (i) the three disposed positions of the three detecting units and (ii) three displacement detection outputs detected by the three detecting units and computes the operation output data based on information on a displacement plane defined by the three three-dimensional detected positions.

12. The operation apparatus of claim 11, wherein a displacement detection axis is defined parallel with the neutral axis, a coordinate plane to indicate the disposed positions of the detecting units is defined perpendicularly to the displacement detection axis, a three-dimensional coordinate space is defined to include the displacement detection axis and the coordinate plane, the three three-dimensional detected positions at which the three detecting units individually abut to the detectable plane are represented as three sets of space coordinates in the three-dimensional coordinate space, and the computing unit computes, as the information on the displacement plane, a normal line vector for a plane including the three sets of space coordinates by using the three sets of space coordinates to thereby obtain a computation result, and computes, based on the computation result, operation output data indicating a tilt radial direction around the neutral axis and a tilt angle displacement from the neutral axis, wherein the tilt radial direction and the tilt angle displacement result from the tilt operation.

13. The operation apparatus of claim 12, wherein the detectable plane uninterruptedly surrounds the basic axis, the detectable plane is tilted in a predetermined radial direction with respect to a basic plane, for which a normal line vector is the basic axis, the operation unit performs a rotation operation around the basic axis while the basic axis accords with the neutral axis, and the computing unit computes operation output data indicating a displacement of the rotation operation, based on the displacement detected by the displacement detector.

14. The operation apparatus of claim 13, wherein the computing unit includes a monitor unit for monitoring a first variation from an initial value with respect to the radial direction and a second variation from an initial value with respect to the tilt angle, and a determination unit for (i) determining that a tilt operation is applied to the operation unit when the first variation exceeds from a first predetermined value and the second variation exceeds from a second predetermined value, and (ii) determining that a rotation operation is applied to the operation unit when the first variation exceeds from the predetermined value and the second variation remains within the second predetermined value.

15. The operation apparatus of claim 11, wherein the detectable plane uninterruptedly surrounds the basic axis, the detectable plane is tilted in a predetermined radial direction with respect to a basic plane, for which a normal line vector is the basic axis, the operation unit performs a rotation operation around the basic axis while the basic axis accords with the neutral axis, and the computing unit computes operation output data indicating a displacement of the rotation operation, based on the displacement detected by the displacement detector.

16. The operation apparatus of claim 11, wherein the basic axis tilts in the certain radial direction among the at least four radial directions with respect to the neutral axis with a tilt center, at which the basic axis and the neutral axis intersect with each other, functioning as a supporting point.

17. The operation apparatus of claim 16, further comprising:

a reception unit for supporting the operation unit and allowing the basic axis to tilt in the certain radial direction among the at least four radial directions with respect to the neutral axis with the tilt center functioning as the supporting point.

18. The operation apparatus of claim 17, wherein the reception unit supports the operation unit and allows the basic axis to tilt in any radial direction with respect to the neutral axis with the tilt center functioning as the supporting point.

19. The operation apparatus of claim 11, wherein the detectable member is shaped of a disc outwardly extending from the operation unit to intersect with the basic axis, and the detectable plane is arranged on one side of the disc to uninterruptedly surround the basic axis.

20. The operation apparatus of claim 11, wherein the detectable member is constructed of segmental members, which individually extend radially from the basic axis while having intervals with each other circumferentially around the basic axis to individually correspond to the detecting units, the detectable plane is defined as a plane including segmental planes, each of which corresponds to an identical side of one of the segmental members, and the segmental planes are arranged to have intervals with each other circumferentially around the basic axis.

21. The operation apparatus of claim 11, wherein the displacement detector has more than three detecting units fixed in individual disposed positions surrounding the neutral axis, and three detecting units are selected from the more than three detecting units for detecting the displacement.

22. The operation apparatus of claim 11, wherein the computing unit computes operation output data indicating a tilt angle displacement of the basic axis with respect to the neutral axis, the tilt angle being generated based on the tilt operation, by using (i) the disposed positions of the three detecting units and (ii) the displacement which is generated by the movement of the detectable plane and detected by the displacement detector.

23. The operation apparatus of claim 11, wherein the operation unit receives a press operation parallel with the neutral axis while the basic axis accords with the neutral axis, and the computing unit computes operation output data indicating a press displacement by using the displacement, which is generated by movement of the detectable plane, the movement being resulting from the press operation, and detected by the displacement detector.

* * * * *